US005429032A

United States Patent [19]

Cytron

[11] Patent Number: 5,429,032

[45] Date of Patent: Jul. 4, 1995

[54] LIGHTWEIGHT MORTAR AND BASEPLATE APPARATUS

[75] Inventor: Sheldon Cytron, Mtn. Lakes, N.J.

[73] Assignee: The United States of America as represented by the Secretary of the Army, Washington, D.C.

[21] Appl. No.: 289,023

[22] Filed: Aug. 10, 1994

[51] Int. Cl.[6] ..... F41A 23/54

[52] U.S. Cl. ..... 89/37.05; 89/1.35; 89/40.06

[58] Field of Search ..... 89/1.35, 37.05, 37.13, 89/40.02, 40.06; 42/105

[56] References Cited

U.S. PATENT DOCUMENTS

| | | | |
|---|---|---|---|
| 691,912 | 1/1902 | McClean | 89/40.06 |
| 1,730,800 | 10/1929 | Brandt | 89/1.35 |
| 1,792,399 | 2/1931 | Schermuly et al. | 89/40.06 |
| 2,694,342 | 11/1954 | Canonne | 89/37.05 |

FOREIGN PATENT DOCUMENTS

| | | | |
|---|---|---|---|
| 29721 | 10/1958 | Finland | 89/37.05 |
| 135757 | 12/1919 | United Kingdom | 89/40.06 |
| 166149 | 7/1921 | United Kingdom | 89/1.35 |

*Primary Examiner*—Stephen M. Johnson

*Attorney, Agent, or Firm*—Anthony T. Lane; Edward Goldberg; Michael C. Sachs

[57] ABSTRACT

A portable lightweight mortar utilizes a triangularly-shaped canvas base plate designed to withstand the high resolved tensile loading stresses generated by mortar firings and transmitted to it by three truss rods which are disposed in grommets located in the canvas corners on one end and are attached by pin/trunnion swivels on its other ends to a gimbaled collar located on the cannon tube.

6 Claims, 1 Drawing Sheet

LIGHTWEIGHT MORTAR AND BASEPLATE APPARATUS

GOVERNMENT INTEREST

The invention disclosed herein may be manufactured, used and licensed by or for the United States Government.

BACKGROUND OF THE INVENTION

Modern warfare has placed increased emphasis on the need for mobility, rapid deployment of men and their armaments, and reduced logistical support. A lightweight, readily-portable mortar system has been a long sought after goal to assist infantry personnel in moving rapidly into offensive firing positions with minimum assistance from supportive groups.

The problem with the present mortar system is that it relies upon a heavy metal base plate to support the rear end of the mortar tube or cannon. Prior art methods for achieving weight reduction mainly focus on simple material substitution, without significant structural changes in design to effect a meaningful weight reduction.

SUMMARY OF THE INVENTION

The present invention relates to a new portable lightweight canvas base plate in substitution for prior art heavy weight metal base plate which dramatically reduces the weight of the old heavy mortar system without compromising performance effectiveness.

An object of the present invention is to replace the prior art metal mortar base plate with a canvas material made from cord of high performance fiber such as manufactured by Allied-Signal's product called Spectra.

Another object of the present invention is to utilize a triangular-shaped canvas mortar base support constructed in a fan-like pattern weave originating from each of the three corners of the canvas.

Another object of the present invention is to provide metal grommet in each corner of the triangular shaped canvas to allow the canvas to be tightly stretched and anchored to the ground.

Another object of the present invention is to provide a grommeted triangularly-shaped mortar canvas support member wherein truss rods may be positioned therein for transmitting to the canvas the impulsive loading stress generated by the mortar firing.

Another object of the present invention is to provide a gimbaled collar having a triangular truss arrangement attached thereto designed to dissipate the impulsive compressive loading into a combination downward loading on stakes and tensile stretch loading on the canvas.

Another object of the present invention is to provide a canvas lightweight mortar base support wherein each mortar firing strongly couples the canvas base support to the ground so that it acts as a large mass to absorb the mortar recoil forces.

A further object of the present invention is to provide a lightweight canvas base mortar support having sufficiently large surface area which when outstretched effectively distributes and minimizes the pressure loading transmitted to the ground by repeat mortar recoil forces.

For a better understanding of the present invention, together with other and further objects thereof, reference is made to the following description taken in connection with the accompanying drawings.

BRIEF DESCRIPTION OF THE DRAWINGS

Throughout the following description like numerals are used to denote like parts of the drawings.

DETAILED DESCRIPTION THE PREFERRED EMBODIMENTS

Figure 2:
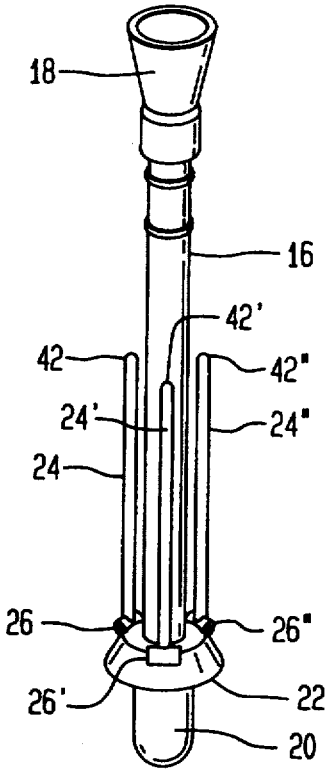
FIG. 2 is an isometric view of the truss rods nested against a cannon tube.
Figure 1:
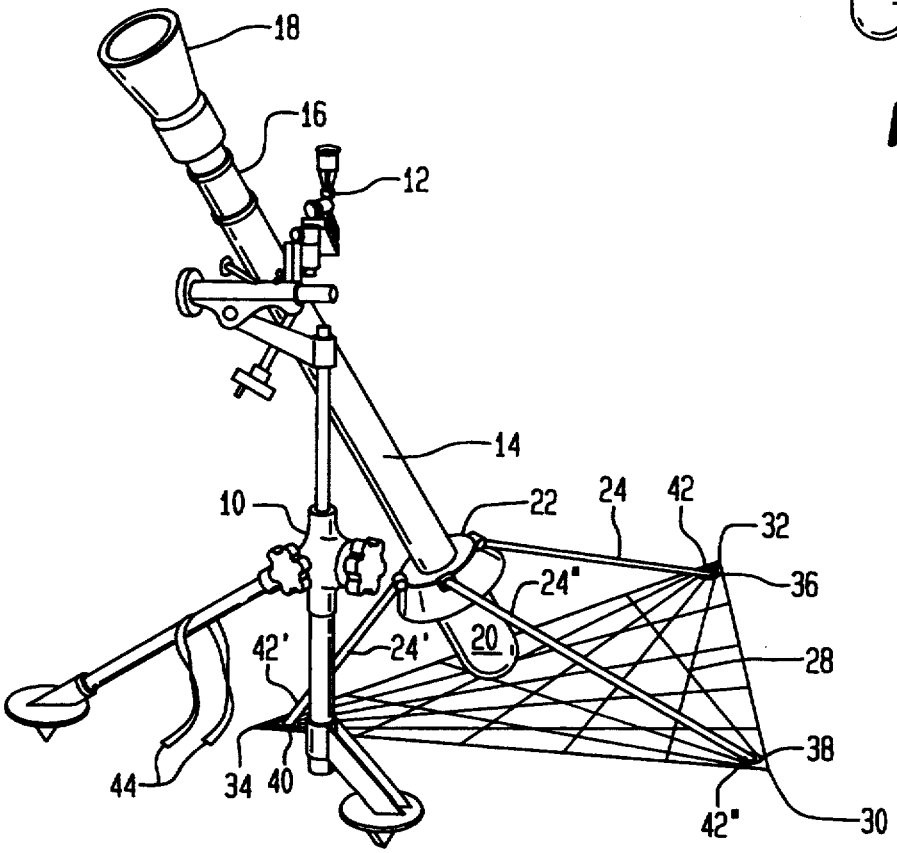
FIG. 1 is an isometric view of the new lightweight mortar base plate design shown attached to a M253 cannon, supported by a M177 mount and a M64A1 self-illuminating sight unit.

Referring now to FIGS. 1 and 2, a conventional M177 mount assembly 10 is used to support a M64A1 self-illuminating sight unit 12 which holds and aligns a mortar such as a M253 cannon at its open upper end 16. The upper end 16 supports a blast attenuation device 18. The lower closed end 20 of the mortar tube 14 supports a gimbaled collar 22 which has three truss rods 24, 24', 24" which are attached to the collar 22 by means of 3 pin/trunnion swivels 26, 26' and 26" respectively.

The traditional, prior art, heavy metal base plate, not shown, is replaced with a high strength lightweight triangular canvas 28. Canvas 28 is woven from cord of high performance fiber material, such as manufactured by Allied-Signal's product Spectra. The canvas 28 is constructed in a fan-like pattern weave originating from each of the three corners 30, 32, and 34 of the canvas 28. Metal grommet fixtures 36, 38, and 40 are operatively disposed in the canvas corners 30, 32, and 34 respectively. The grommet fixtures 36, 38, and 40 are used for inserting stakes, not shown, into the ground so as to tightly stretch out the canvas 28 and firmly anchor it to the ground. Each of the three corner grommet fixture 36, 38, and 40 will also accept and hold truss rods 24, 24', and 24" bottom ends 42, 42', and 42" therein. The canvas 28 is designed to withstand the high tensile loading stresses generated by mortar firings and transmitted to it by the three truss rods 24, 24' and 24". The traditional single center point loading on a metal base plate is not used. In the present invention, as shown in FIG. 1, the triangular truss arrangement is designed to dissipate the impulsive compressive loading into a combination of a downward loading on the stakes, not shown, and a tensile stretch loading on the canvas 28. Thus each firing strongly couples the canvas 28 to the ground so that it acts as a large mass to absorb the cannon's 14 recoil forces. The large surface area of the outstretched canvas 28, effectively distributes and minimizes the pressure loading transmitted to the ground. The Spectra fiber used in canvas 28 has the highest specific strength and modulus of any known material. Its specific gravity is 0.97 making it very lightweight for man-portability. This canvas material lends itself to nuclear, biological and chemical decontamination procedures and shows no degradation in characteristics after acid/base exposures. The fiber material of canvas 28 also has excellent energy dissipation characteristics which allows the canvas 28 to adsorb shock and impact loadings very effectively. A pair of straps 44 are used to lock together the legs of the M177 mount unit when it is being carried from location to location.

In operation the gimbaled collar 22 is permanently mounted to a cannon tube 14. The gimbal support structure 22 allows for two axis rotation of the cannon tube 14 for aiming purposes by a sight unit 12 such as an M64A1. The prior art sight unit 12 is operatively supported by a conventional M177 mount. In FIG. 2 the truss rods 24, 24' and 24" are shown nested against the cannon tube 14 during storage or portage. When the cannon tube 14 is positioned for firing the truss rods 24, 24', and 24" are swung out and inserted into the canvas grommets 36, 38, and 40, respectively. A pin and trunnion swivel 26, 26', and 26" operatively supported by gimbal collar 22 allows the truss rods 24, 24', and 24" the flexibility of movement necessary at mortar emplacement and aiming.

A preferred material of construction for the truss rods 24, 24', and 24" is a lightweight boron-aluminum metal matrix composite. This material is lightweight and has both a high compressive strength and stiffness modulus. The gimbaled collar is designed as an integral part of the cannon tube 14. Further weight reduction is achieved by utilizing high strength composite materials for the tube 14.

While a specific embodiment of the invention has been shown and described in detail to illustrate the application of the principles of the invention, it will be understood that the invention may be embodied otherwise without departing from such principles.

What is claimed is:

1. A portable lightweight mortar weapon system comprising a cannon means for firing mortar ammunition, said mortar weapon system further comprising:

mount means for operatively supporting an upper section of said mortar weapon system;

sighting scans removably connected to said mount means for aiming said mortar weapon system;

said cannon means having an upper open end operatively connected to said sighting means and a lower closed end for holding propellant gases therein;

gimbal collar means operatively attached intermediate said upper and lower ends of said cannon means for allowing said cannon means to be rotated;

a plurality of truss means operatively connected to said gimbal collar means for supporting the lower end of said cannon means; and canvas means for holding said truss means and for distributing and minimizing any pressure loading transmitted to the ground in operation of said mortar weapon system by any recoil forces of said cannon means.

2. A portable lightweight mortar as recited in claim 1 wherein said truss means includes:

three truss rods attached to said gimbal collar by three pin and trunnion swivels.

3. A portable lightweight mortar as recited in claim 2 wherein said truss rods are made of a lightweight boron-aluminum metal matrix composite material.

4. A portable lightweight mortar as recited in claim 3 wherein said canvas means includes:

a triangularly-shaped canvas material constructed of cord material.

5. A portable lightweight mortar as recited in claim 4 wherein said canvas material is constructed in a fan-like pattern weave originating from each of three corners of said triangularly-shaped canvas.

6. A portable lightweight mortar as recited in claim 5 wherein said triangularly-shaped canvas material has a metal grommet fixture operatively disposed in each corner of said three corners thereof for holding therein said truss means.

* * * * *